United States Patent [19]

Spies

[11] 4,087,952

[45] May 9, 1978

[54] CRIMPING MECHANISM FOR AN ELECTRIC CAPPING MACHINE

[75] Inventor: Philip E. Spies, Baltimore, Md.

[73] Assignee: National Instrument Company, Inc., Baltimore, Md.

[21] Appl. No.: 714,180

[22] Filed: Aug. 13, 1976

[51] Int. Cl.[2] ..... B65B 7/28; B67B 3/18

[52] U.S. Cl. ..... 53/334; 53/331; 53/368

[58] Field of Search ..... 53/334, 331, 329, 335, 53/336, 337, 42, 77, 351, 78, 306, 308, 368

[56] References Cited

U.S. PATENT DOCUMENTS

| | | | |
|---|---|---|---|
| 1,469,874 | 10/1923 | Beardsley et al. | 53/368 X |
| 2,875,566 | 3/1959 | Sevenpifer | 53/334 |
| 3,713,268 | 1/1973 | Gess | 53/334 |
| 3,878,667 | 4/1975 | Holstein | 53/368 X |
| 3,964,234 | 6/1976 | Hurst | 53/334 X |

*Primary Examiner*—Harrison L. Hinson
*Assistant Examiner*—Horace M. Culver
*Attorney, Agent, or Firm*—Craig & Antonelli

[57] ABSTRACT

A crimping mechanism for an electric capping machine has a rapidly adjustable threaded ferrule and a crimping head base with a calibrated bracket, enabling the operator to simplify adjustments for changes in container size. The crimping roller is mounted to exert a substantially constant pressure against the container cap, and thereby increase its crimping efficiency.

5 Claims, 1 Drawing Figure

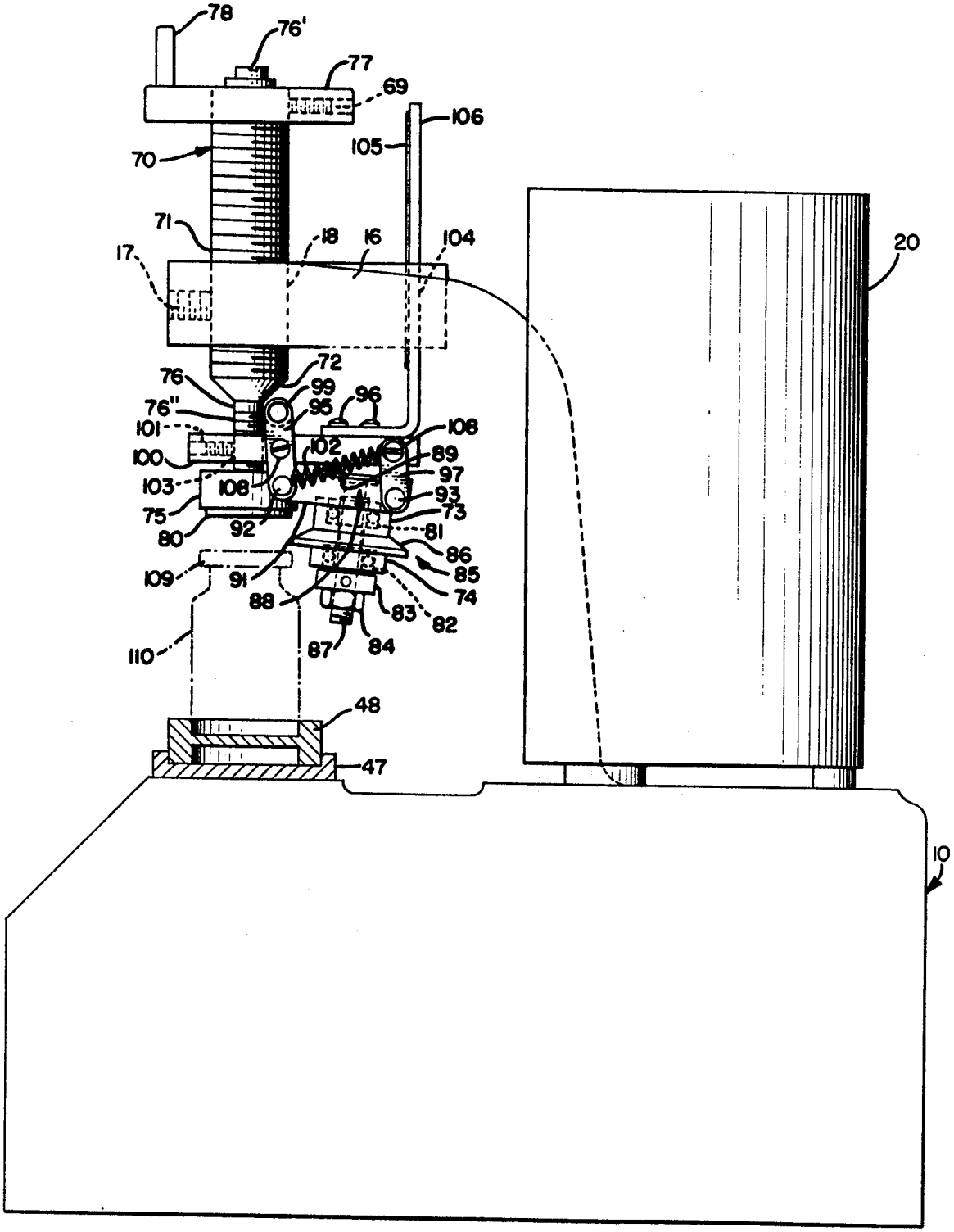
78
76'
77
69
106
105
70
71
18
16
104
20
17
72
76
99
96
76"
95
101
108
100
102
89
97
103
108
93
75
73
80
92
81
86
109
91
85
88
74
83
82
87
84
110
48
47
10

CRIMPING MECHANISM FOR AN ELECTRIC CAPPING MACHINE

BACKGROUND OF THE INVENTION

1. Field of the Invention

The present invention relates to an electric capping machine, more particularly, to a semi-automatic electric capping machine for crimping the caps of containers, bottles, vials and the like.

2. Description of the Prior Art

In application Ser. No. 539,044, filed Jan. 7, 1975, and now U.S. Pat. No. 3,964,234, for Capping Machine, by Richard F. Hurst, there is described a significant improvement in electric capping machines. That improved capping machine affords the automatic operation of each cycle of the machine, once initiated by the operator. In the course of each operation, a container receiving member is automatically raised into engagement with a spring loaded abutment roller of the crimping mechanism. Upon further upward movement, the container-receiving member causes the crimping roller to engage the edge of the cap by way of a quadrilateral linkage connection which is activated by a cam follower. This quadrilateral supporting linkage for the crimping roller provides a very reliable, completely constructed mechanism for moving the crimping roller and maintaining it in defined positions for various adjustments of the crimping head.

The crimping mechanism includes an externally threaded housing ferrule having a tapering portion forming a camming surface. The housing ferrule is threadably received within a threaded bore provided in the reinforced elongated top center housing portion of the machine. To provide for proper crimping of the edge of the cap of a container, the crimping mechanism is adjusted by a tool such as a screwdriver which engages a transverse slot at the upper end of a shaft disposed within the housing ferrule.

The crimping roller is rotatably supported on a shaft portion of a crimping head holder which projects from a flat base portion contained within the quadrilateral linkage. This shaft portion takes the form of a single thrust bearing.

Now, although the above described capping machine offers significant improvements over the prior art, shortcomings have developed with respect to the structure of the crimping mechanism proper.

For example, due to the manner in which the housing ferrule engages the top center housing portion of the machine, readjustment of the position of the crimping mechanism relative to the container-receiving platform, when changing over from one bottle height to another, is time consuming and requires trial and error adjustment.

In addition, the efficiency of the crimping roller has suffered due to the amount of play resulting from the thrust and bearing type of engagement with the quadrilateral linkage and the resulting ability of the crimping roller to float up and down with respect to the base portion within the linkage.

SUMMARY OF THE INVENTION

It is, accordingly, an object of the present invention to provide an improved capping machine of the type disclosed in the above-referred to U.S. patent application, which permits rapid adjustment of the height of the crimping head assembly relative to the container-receiving platform by the machine operator.

It is a further object of the present invention to provide an improvement in the above described capping machine in which the efficiency of the crimping roller is significantly increased.

Briefly, in accordance with the present invention, the crimping head assembly includes an elongated externally threaded housing ferrule which passes completely through the top center housing portion of the capping machine and has an adjusting wheel affixed thereto. Rotation of the adjusting wheel causes vertical displacement of the crimping head assembly relative to the container-receiving platform. An indicia containing angle bracket is attached to the crimping head base and passes through a slot in the top center housing portion to permit the operator to read, at a glance, the height of the crimping head assembly and adjust its height according to bottle size.

The crimping roller engages the crimping head holder by an elongated shaft ball bearing arrangement. An adjusting screw is provided for accurately setting the position of the crimping roller relative to the quadrilateral linkage. The ball bearing assembly prevents play and assures uniform pressure by the crimping roller against the bottle during crimping rotation.

BRIEF DESCRIPTION OF THE DRAWINGS

The single FIGURE illustrates the improved capping machine according to the invention and shows, in detail, the structure of the crimping head and roller assemblies.

DETAILED DESCRIPTION OF THE INVENTION

Referring now to the single FIGURE, which is similar to FIG. 2 of the above-referred to Hurst patent application, the improved electric capping machine of the present invention includes a housing generally designated by reference numeral 10, an electric motor 20, and a crimping mechanism. The basic details of the motor 20, the housing 10, and the gearing arrangements contained therein are set out in the above-referred to application to which reference may be had for a complete explanation thereof. The present invention is directed to the crimping mechanism, a detailed description of which will follow.

The crimping mechanism of the capping machine of the present invention includes a housing ferrule generally designated by reference numeral 70 which includes an externally threaded portion 71 and an adjoining tapered portion 72 forming a camming surface. The housing ferrule 70 is threadably received within a threaded bore 18 provided in the reinforced elongated top center housing portion 16. An abutment roller 75 is connected with a spring-loaded shaft 76 which is slidably received within the housing ferrule 70 and slidingly extends through the downwardly tapering portion 72. The shaft 76 and the roller 75 are normally urged in the downward direction by a spring (not shown) engaging at the upper end against an upper fixed spring abutment and at the lower end against a spring washer or plate fixed on the shaft.

The details of this spring loaded arrangement are disclosed in detail in the above-referred to Hurst application. A ball bearing may be interposed between the shaft 76 and the abutment roller 75 to enable relative rotation between the shaft 76 and the roller 75.

The crimping mechanism of the present invention is adjustable by up and down movement of shaft 76 to provide for proper crimping of the edge of the cap. For that purpose, the upper end of the ferrule is provided with a transverse slot 76' for engagement with a tool, such as a screwdriver. On the uppermost portion of the housing ferrule 70 there is affixed an adjusting wheel 77 having a handle 78. The wheel 77 is provided with a bore 69 for receiving a setscrew to affix the handle to the ferrule. By turning the adjustment wheel 77 the ferrule 70, and accordingly, the cap holder 80 at the bottom of the roller 75 may be rapidly displaced in the vertical direction.

The crimping roller, generally designated by reference numeral 85 and made, for example, of nylon or equivalent material includes a bevelled crimping surface 86 adapted to engage with the cap 109 of a container 110 during the crimping action. The crimping roller 85 is rotatably supported on a shaft 87 of a crimping head holder generally designated by reference numeral 88, whereby the shaft portion 87 projects from a flat base portion 89 which is adjoined on both sides thereof by a pair of perpendicularly extending side walls 91 which are somewhat longer than the base portion 89 and which are provided at the two ends thereof with outwardly projecting pivot pins 92 and 93. Two three-hole link members 95 are thereby pivotally connected with the pins 92 while two two-hole links 97 are thereby pivotally connected with the pins 93, respectively. Each of the links 95, 97 is threadably secured by means of appropriate screws 108 with a crimping head base generally designated by reference numeral 100 to provide thereby a quadrilateral linkage connection between the crimping head base 100, on the one hand, and the crimping head holder 88 as well as the crimping roller 85, on the other. Further details of the crimping head base are disclosed in the above-referred to Hurst application. The upper ends of the links 95 support therebetween a roller member 99 forming a cam follower which is operable to follow the tapered camming surface 72 of the housing ferrule 70 to provide the automatic inward movement of the crimping roller 85 toward the edge of the cap 109 as the cap of the container comes into engagement with the abutment roller 75 while being elevated. To ensure continuous engagement between the cam follower roller member 99 and the tapering surface 72, spring 102 is provided which engages with pins 92 and 108. The crimping head base 100 is fastened to the shaft 76, for example, by a set screw 101 which is adapted to engage in the threaded bore 103 of the crimping head base 100. Hence, any upward movement of the abutment roller 75 together with shaft 76 will result in an identical upward movement of the crimping head base 100, thereby causing the roller member 99 to run up along the tapering surface 72 and thereby causing the link member 95 to pivot in the clockwise direction, as viewed in the FIGURE, whereby, as a result of the quadrilateral linkage, the crimping roller 85 is caused to undergo a positively controlled movement inwardly toward the edge of the cap.

The crimping roller itself has upper and lower cylindrical portions 73 and 74, respectively between which the crimping surface 86 is disposed. The roller is coupled to and rotates about shaft 87 by way of ball bearings 81 and 82, and adjusting screw 83 which obviate play between the roller and the shaft and permit a substantially constant pressure to be exerted by crimping surface 86 as the crimping roller crimps the edge of the container cap. As shown in the FIGURE, the bearings 81, 82 are mounted within the roller 85, and the adjusting screw 83 is mounted within the roller and bearings so as to enable the vertical positioning of the roller to be adjusted by rotation of the screw upon threaded shaft 87. The nut 84 is provided to secure the position of the roller on shaft 87 for maintaining the desired crimping pressure by acting as a common lock nut which prevents the crimping roller from floating up and down on shaft 87 in conjunction with screw 83 and, thus, increases the efficiency of the crimping roller.

On the upper surface of the crimping head base 100 an angle bracket 106 is mounted by way of screws 96. The bracket 106 carries a scale 105 and both pass through a slot 104 in the reinforced center portion 16 of the housing. The scale may be calibrated according to bottle size to permit the operator to rapidly adjust the position of the ferrule 70 for different bottle sizes by merely turning the adjusting wheel 77 while observing the scale 105.

The operation of the machine is basically as described in the above-referred to Hurst application. As the platform 47 and vial insert 48 are raised, the cap 109 on container 110 is brought into engagement with cap holder 80 and abutment roller 75. This causes the shaft 106 and therewith the crimping head base 100 to move upwardly a predetermined distance so that the roller 99 follows the tapering surface 72 in this upward motion and thereby causes the crimping roller 88 to be brought into engagement with the edge of the cap 109 of container 110. As the platform 47 and container-receiving vial insert 48 and therewith the container 110 itself are again lowered, the spring loaded ferrule will cause the parts 75, 76 and 100 to be also lowered again, thereby pivoting the link member 95 in the counterclockwise direction as viewed in the FIGURE since the roller member 99 now slides down along the tapering surface 72, whence the crimping roller 85 is now pivoted out of engagement with the edge of the cap 109. When the cycle is completed, the operator will then remove the container with the crimped cap thereon and will place another container with an uncrimped cap thereon into the vial insert 48 and will then start another cycle of operation.

While we have shown and described only one embodiment in accordance with the present invention it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

We claim:

1. In a capping machine for crimping the caps of containers, said capping machine having a housing, a container-receiving platform which is adapted to be rotated, raised and lowered, and a crimping mechanism disposed above said platform and being operable to engage the cap of a container on the platform when the platform is raised and rotated, said crimping mechanism including a housing member having a downwardly tapering camming surface, and threadingly engaging said housing, an abutment member mounted on a shaft within said housing member and axially displaceable with respect thereto, a crimping head base connected with said shaft, a crimping roller engageable with said cap, and linkage means operatively connecting said crimping roller with said crimping head base and including a cam follower member operable to engage the tapering camming surface of said housing member during axial movement of said abutment member, the improvement comprising:

said housing member being provided with a rotatable adjusting wheel for rotating said housing member and thereby vertically displacing said abutment member relative to said container-receiving platform, a bracket being affixed to said crimping head base and passing through a slot in said housing so as to prevent rotation of said crimping mechanism during the operation of said externally adjusting means, and said bracket being provided with an index scale for registering the position of said crimping head base relative to a prescribed location on said housing, whereby the machine can be quickly and easily adapted for use in crimping caps on containers of various sizes.

2. In a capping machine for crimping the caps of containers, said capping machine having a housing, a container-receiving platform which is adapted to be rotated, raised and lowered, and a crimping mechanism disposed above said platform and being operable to engage the cap of a container on the platform when the platform is raised and rotated, said crimping mechanism including a housing member having a downwardly tapering camming surface, an abutment member mounted on a shaft within said housing member and axially displaceable with respect thereto, a crimping head base connected with said shaft, a crimping roller engageable with said cap, and linkage means operatively connecting said crimping roller with said crimping head base and including a cam follower member operable to engage the tapering camming surface of said housing member during axial movement of said abutment member, the improvement wherein said crimping mechanism further includes a shaft member affixed to said crimping head base, said crimping roller being rotatably arranged on said shaft member by way of a ball bearing mechanism and an adjustment screw, said adjustment screw mounting said crimping roller on said shaft member, controlling the amount of crimping pressure applied by way of said roller during rotation thereof about said shaft member, and preventing said roller from floating up and down on said shaft.

3. The improvement according to claim 2, wherein said ball bearing mechanism is mounted within said roller, said adjusting screw is mounted upon said shaft and within said roller, and said adjusting screw acts in conjunction with a nut to secure the roller in place axially relative to said shaft.

4. The improvement according to claim 2, wherein said housing member is theadingly engaged with said housing and is provided with a rotatable adjusting wheel for rotating said housing member and thereby vertically displacing said abutment member relative to said container-receiving platform.

5. The improvement according to claim 4, wherein said crimping head base is provided with means, coupled with said housing for preventing rotation of said crimping mechanism during the operation of said externally adjusting means.

* * * * *